US007593666B2

(12) United States Patent
Ibaraki

(10) Patent No.: US 7,593,666 B2
(45) Date of Patent: Sep. 22, 2009

(54) DEVELOPING DEVICE WITH OVERLAPPING SEALING MEMBERS WITH REDUCED THICKNESSES

(75) Inventor: Masahumi Ibaraki, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 164 days.

(21) Appl. No.: 11/695,636

(22) Filed: Apr. 3, 2007

(65) Prior Publication Data

US 2007/0237540 A1 Oct. 11, 2007

(30) Foreign Application Priority Data

Apr. 5, 2006 (JP) ..... 2006-103963

(51) Int. Cl.
*G03G 15/08* (2006.01)

(52) U.S. Cl. ..... 399/103; 399/102; 399/105

(58) Field of Classification Search ..... 399/103
See application file for complete search history.

(56) References Cited

U.S. PATENT DOCUMENTS

| | | | | |
|---|---|---|---|---|
| 6,090,479 | A * | 7/2000 | Shirato et al. | 428/304.4 |
| 6,195,515 | B1 * | 2/2001 | Fujita et al. | 399/103 |
| 6,980,752 | B2 * | 12/2005 | Kamimura | 399/103 |
| 2001/0009618 | A1 * | 7/2001 | Ohgoshi et al. | 399/103 |
| 2005/0152714 | A1 * | 7/2005 | Lansdown | 399/103 |
| 2006/0025489 | A1 * | 2/2006 | Yano | 521/99 |

FOREIGN PATENT DOCUMENTS

| | | |
|---|---|---|
| JP | 11316500 | 11/1999 |
| JP | 2000075656 | 3/2000 |

* cited by examiner

*Primary Examiner*—David M Gray
*Assistant Examiner*—Billy J Lactaoen
(74) *Attorney, Agent, or Firm*—Lucas & Mercanti, LLP

(57) ABSTRACT

A development device includes a plurality of soft members, wherein at least one of the plurality of soft members has an end portion having a shape section of which width is smaller toward a tip end of the end portion; and wherein the end portion is placed on another one of the soft members.

16 Claims, 7 Drawing Sheets

CROSS-SECTION Y-Y

CROSS-SECTION X-X

CROSS-SECTION Y-Y

CROSS-SECTION X-X

DEVELOPING DEVICE WITH OVERLAPPING SEALING MEMBERS WITH REDUCED THICKNESSES

FIELD OF THE INVENTION

The present invention relates to a development device used for an image forming apparatus of an electrophotographic type, and particularly relates to a development device that prevents leakage of toner from a gap between members provided in the development device.

BACKGROUND OF THE INVENTION

In an image forming apparatus of an electrophotographic type, toner is stored in a development device constructing a process unit, transported from a supply roller to a development roller of the development device, and supplied to a photoreceptor drum through the development roller. A section that performs toner supply to the photoreceptor drum is arranged with an opening of the development device so as to supply toner toward outside from inside of the development device. Such a section or region that performs toner supply to a photoreceptor drum through a development roller is hereinafter referred to as a development region.

It is required to efficiently supply toner to a photoreceptor drum in a development region, while leakage of toner from other sections must be avoided because toner splash affects the exposure optical path and causes contamination of the inside of an image forming apparatus, including a charger. Therefore, sealing is applied to gaps of a development device, from which toner is preferably prevented from leaking.

In many cases, gaps formed between components of a development device have complicated shapes. Accordingly, in order to seal such sections, members for sealing (hereinafter, also referred to as sealing members) to fit a complicated shape are required. In such a situation, sealing members are forced to have a complicated shape. Forming such a sealing member into one body increases the difficulty of making the sealing member, and further, it becomes difficult to incorporate it to a portion of a gap, from which leakage of toner is to be avoided. Accordingly, it is practical to produce several divided sealing members, incorporate the sealing members in a combination at a desired section of a development device, and thus sealing is done.

As examples of concrete technologies for the purpose of prevention of toner leaking to outside of a process unit, Patent Document 1 (Japanese Patent Publication TOKKAI No. H11-316500) discloses a technology in which a protrusion is provided at a portion where a side seal and bottom seal of a development roller are superposed with each other, and Patent Document 2 (Japanese Patent Publication TOKKAI No. 2000-75656) discloses a technology which specifies the shape of an end portion of a lower seal in a region where a development roller and a side seal are superposed with each other.

However, the above development device, having a structure which is sealed such that several divided sealing members in a combination are incorporated at a desired section of the development device, may be insufficiently prevented from toner leakage at the jointing section of the combined sealing members. In other words, a structure in which end surfaces of the sealing members are brought into contact with each other tends to cause a gap between end surfaces of the sealing members that are brought into contact with each other, and accordingly toner leaks through the gap once it is generated.

Further, even in a case where a structure with superposed sealing members in a combination at the jointing section is employed so as to prevent generation of a gap between end surfaces of sealing members at the jointing section, a step may be generated at the boundary section of the superposed sealing members, and toner may leak through the step. As described above, for a structure for sealing by incorporating a combination of several divided sealing members at a desired section of a development device, sealing members can be easily produced and incorporated, but there is still a problem to be solved for prevention of toner leakage.

An object of the present invention is to provide a development device having a structure for sealing at a desired section of the development device by incorporating a combination of several divided sealing members so as to prevent leakage of toner from the jointing section of the sealing members.

SUMMARY OF THE INVENTION

To solve problems, as described above, in an aspect of the present invention, there is provided a development device, including:

a plurality of soft members, wherein at least one of the plurality of soft members has an end portion having a shape section of which width is smaller toward a tip end of the end portion;

and wherein the end portion is placed on another one of the soft members.

DETAIL DESCRIPTION OF THE PREFERRED EMBODIMENT

Figure 1:
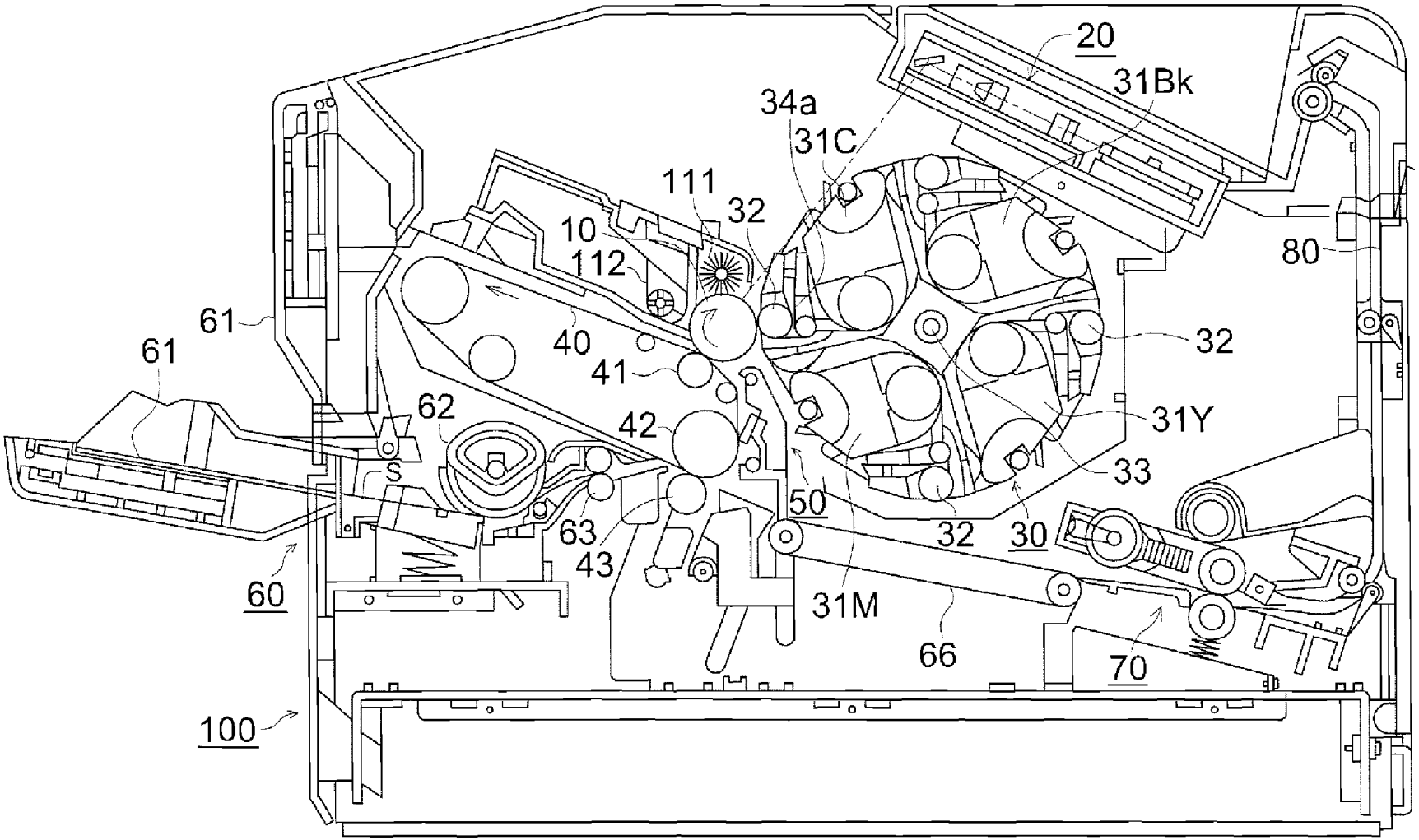
FIG. 1 is an entire view of an image forming apparatus in which a development device in accordance with an embodiment of the present invention is incorporated.

In the present invention, soft members are used as sealing members of a development device. For sealing with a combination of these members, at least one of the soft members has an end portion which has a shape section having a width smaller toward the tip end, and this end portion is placed on another soft member to make sealing. Thus, it is possible to provide a development device, wherein toner leakage from jointing sections of the sealing members and jointing sections of other members of the development device is prevented, neither contamination in the apparatus nor image contamination occurs in image recording, and stable printing is realized.

The present invention relates to a development device employing a plurality of soft members, wherein a gap formed between the members is sealed. The inventor has considered a method which prevents generation of a step which may be generated when soft members are superposed. The inventor paid attention to the fact that when a soft member is pressed, as the pressed area of the member is smaller, the compressed amount of the member is larger and the volume of the member becomes smaller. Consequently, the inventor determined that a soft member and another soft member can be jointed, without causing a step therebetween, by making the contact area between the soft members in a region of superposing the soft members be small, and thus devised the present invention.

A soft member referred to in the present invention is one that is elastically deformed with a center at the position where a force is applied, and returns to the original shape when the force is released. Soft polyurethane foam (hereinafter, also referred to as soft urethane foam) is a representative with specific commodities of, for example, "Moltplane produced by INOAC Corporation" and "Superseal WG produced by NHK Spring CO., Ltd.". Other soft members applicable to the present invention include urethane eslastomer and rubber sponge, which is available in the market. Specific commodities of urethane elastomer are, for example, "G mat produced by Trusco Nakayama Corporation) and "Geltape produced by GELTECH Co., Ltd."

Characteristics of a soft member can be quantified by measuring hardness, rebound resilience, and the like. Herein, measurement of the hardness of a soft member is, for example, carried out, in accordance with D method of JIS K 6400 (obtaining hardness under a constant compression of 25%) using a compression testing machine for urethane foam. D method of JIS K 6400 defines the value of hardness by the force (unit; Newton) required to compress a urethane foam of a disk shape with a diameter of 200 mm, by 25% from the original thickness. The measurement method by D Method of JIS K 6400 is carried out in the following procedure.

(1) To dispose a test piece on a testing table at the center.

(2) To press a pressing plate against the test piece, read the thickness of the test piece by a unit of 0.1 mm when a predetermined force specified by D Method of JIS K 6400 is applied, and define the thickness as the initial thickness of the test piece.

(3) To press the pressing plate at a speed of 100±20 mm/min to the thickness of 75±2.5% of the initial thickness of the test piece and then instantly release the pressing plate.

(4) To press the pressing plate at a speed of 100±20 mm/min to the thickness of 25±1% of the initial thickness of the test piece, and maintain a static state.

(4) To read the value of the force at the time when 20 seconds have elapsed since the start of the static state, and define this value as "hardness".

The thickness of each soft member returns to a range of 40% to 100% of an original thickness, after a hardness of the soft member is measured by D Method of JIS K6400.

For measurement of a soft member, it is possible to use a testing device for soft foam, such as "automatic hardness testing machine AF-200 type (product of KOUBUNSHI KEIKI CO., Ltd.)".

The hardness applicable to the present invention is preferably in the range of 10 to 400 N. Adopting a soft member in this range of hardness achieves both a sufficient sealingness and forming of a smooth superposition at the superposition section.

Further, it is possible to quantify the characteristics of a soft member applicable to the present invention, by measuring the rebound resilience. Herein, the rebound resilience is, for example, a measure indicating the energy that a soft member absorbs when it receives a shock load, and is measured with a Ryupke type rebound resilience testing machine in accordance with JIS K 6255 (Testing methods of rebound resilience for vulcanized rubber or thermoplastic), for example. Concrete Ryupke type rebound resilience testing machines are, for example, "No. 200 type testing machine produced by YASUDA-SEIKI-SEISAKUSHO Ltd." and "VR-6500 series produced by UESHIMA SEISAKUSHO CO., Ltd.".

An example of a full-color image forming apparatus that forms full-color images by the use of a development device in accordance with the present embodiment of the invention will be described, referring to FIG. 1.

Around a photoreceptor drum 10 rotationally driven in the full-color image forming apparatus, shown in FIG. 1, there are provided a charging brush 111 to uniformly charge the surface of a photoreceptor drum 10 to a predetermined electric potential, a cleaner 112 to wipe off toner remaining on the photoreceptor drum 10, and the like.

Further, a laser scanning optical system 20 is provided that scan-exposes, with laser beams, the photoreceptor drum 10 charged by the charging brush 111. The laser scanning optical system 20 is a known one and contains a laser diode, polygon mirror, and fθ optical device. Printing data is transmitted for yellow, Magenta, cyan, and black respectively, from a host computer to the control section of the laser scanning optical system 20. The laser scanning optical system 20 outputs laser beams sequentially, based on the printing data for the respective colors, scan-exposes on the photoreceptor 10, and thus sequentially forms static latent images on the photoreceptor drum 10 for the respective colors.

Further, a full-color development device 30 that performs development in full-color, supplying toners in respective colors to a photoreceptor drum 10 on which electrostatic latent images have been formed, is provided with development units 31Y, 31M, 31C, and 31Bk storing respective non-magnetic single component toners of yellow, magenta, cyan, and black, around a support shaft 33. These development units 31Y, 31M, 31C, and 31Bk are rotated with the supporting shaft at the center, and guided to a position facing the photoreceptor drum 10.

With regard to development units 31Y, 31M, 31C, and 31Bk of the full cooler development device 30, toner restricting members are in press-contact with the circumferential surfaces of development agent carriers (development rollers) 32 that rotate and feed toner, as shown in FIG. 1. These toner restricting members restrict the amounts of toners fed by the development rollers 32 and charge the fed toners. Herein, the full color development device 30 may be provided with two toner restricting members for each development roller in order to properly restrict and charge toners fed by the development rollers.

Each time a respective electrostatic latent image is formed, as described above, on the photoreceptor drum 10 by the laser scanning optical system 20, the full-color development device 30 is rotated around the support shaft 33, as described above. Thus, each of development unit 31Y, 31M, 31C, and 31Bk storing the toners in the respective colors is sequentially guided to the position facing the photoreceptor drum 10. A development roller 32 of each of development unit 31Y, 31M, 31C, and 31Bk is made contact with the photoreceptor drum 10, and thus each charged toner in respective color is sequentially supplied onto the photoreceptor drum 10 on which each electrostatic latent image for the respective color has been formed, thus development being performed.

Still further, an intermediate transfer belt 40, which is in an endless form and rotationally driven, is provided, as an intermediate transferor, at a position on the downstream side in the rotation direction of the photoreceptor drum 10 with respect to the full-color development device 30. The intermediate transfer belt 40 is rotationally driven, synchronizing with the photoreceptor drum 10. The intermediate transfer belt 40 is pressed by a rotatable primary transfer roller 41 to contact the photoreceptor drum 10. Further, a secondary transfer roller 43 is rotatably provided at the position of a support roller 42 for supporting the intermediate transfer belt 40 so that a recording material S, such as a recording paper sheet, is pressed against the intermediate transfer belt 40 by the secondary transfer roller 43.

Yet further, a cleaner 50 for wiping off toner remaining on the intermediate transfer belt 40 is provided attachably to and detachably from the intermediate transfer belt 40, in a space between the full-color development device 30 and the intermediate transfer belt 40.

Further, a sheet feeding unit 60 for guiding a recording material S, such as a plain paper sheet, to the intermediate transfer belt 40 is constructed with a sheet feeding tray 61 for storing recording material S, a sheet feed roller 62 for feeding the recording material S stored in the sheet feeding tray 61 one by one, and a timing roller 63 for conveying a recording material S having been fed, to the position between the intermediate transfer belt 40 and the secondary transfer roller 43, in synchronization with an image formed on the intermediate transfer roller 40. The recording material S having been conveyed to the position between the intermediate transfer belt 40 and the secondary transfer roller 43 is pressed against the intermediate transfer belt 40 by the secondary transfer belt 43 so that the toner image is transferred from the intermediate transfer belt 40 to the recording material S by pressing.

The recording material S to which the toner image has been transferred, as described above, is then guided to the fixing device 70 by a conveying unit 66 constructed with an air suction belt or the like. This fixing device 70 fixes the transferred toner image on the recording material S, and then the recording material S is ejected through a vertical conveying path 80 to the top surface of the apparatus main body 100.

Now, operation of image forming in full-color by the use of this full-color image forming apparatus will be specifically described.

First, the photoreceptor drum 10 and the intermediate transfer belt 40 are rotationally driven at the same speed in the respective directions, and the photoreceptor 10 is charged by the charging brush 111 to the predetermined electric potential.

Then, the charged photoreceptor drum 10 is exposed by the laser scanning optical system 20 for a yellow image, and thereby an electrostatic latent image is formed for a yellow image. Then, charged yellow toner is supplied to the photoreceptor drum 10 by the toner restricting member, as described above, from the development unit 31Y storing yellow toner so as to develop the yellow image. The intermediate transfer belt 40 is pressed, with the primary transfer roller 41, against the photoreceptor drum 10 on which a yellow toner image has been formed by, and thereby the yellow toner image formed on the photoreceptor drum 10 is primarily transferred to the intermediate transfer belt 40.

After the yellow toner image is transferred to the intermediate transfer belt 40 in such a manner, the full-color development device 30 is rotated around the support shaft 33, and the development unit 31M storing magenta toner is guided to the position facing the photoreceptor drum 10. Same as in the case of the yellow image, the charged photoreceptor drum 10 is exposed by the laser scanning optical system 20 for a magenta image to form an electrostatic latent image, and the electrostatic latent image is developed by the development unit 31M storing the magenta toner. The developed magenta toner image is primarily transferred from the photoreceptor drum 10 to the intermediate transfer belt 40. Further, exposure, development, and primary transfer are sequentially performed, likewise, for a cyan image and black image, and accordingly yellow, magenta, cyan, and black toner images are sequentially superimposed on the intermediate transfer belt 40, thereby forming a toner image in full-color.

When the black toner image, which is the last, has been primarily transferred onto the intermediate transfer belt 40, the recording material S is conveyed to the position between the secondary transfer roller 43 and the intermediate transfer belt 40 by the timing roller 63, and the recording material S is pressed by the secondary roller 43 against the intermediate transfer belt 40. Thus, the full-color toner image having been formed on the intermediate transfer belt 40 is secondarily transferred to the recording material S.

When the full-color tone image has been secondarily transferred onto the recording material S in such a manner, the recording material S is guided to the fixing device 70 by the conveying unit 66, described above, and the transferred full-color toner image is fixed by the fixing device 70 onto the recording material S. Then, the recording material S is ejected through the vertical conveying path 80 onto the top surface of the apparatus main body 100.

Now, the development device in accordance with the present invention will be described.

As described above, the image forming apparatus in the present embodiment of the invention is provided with four development units 31Y, 31M, 31C and 31Bk having the same structure. The four development units 31Y, 31M, 31C and 31Bk are respectively provided with development rollers 32Y, 32M, 32C and 32Bk, and store toners in respective different colors of yellow, magenta, cyan and black in containers formed in a combination of plural hard members. The respective development rollers 32Y, 32M, 32C and 32Bk are made contact with the photoreceptor drum 10 on which electrostatic latent images of the respective colors have been sequentially formed by the laser scanning optical system 20, and toners in the respective colors are sequentially supplied to perform development. It is required to efficiently supply toner through the respective development rollers 32Y, 32M, 32C and 32Bk to the photoreceptor drum, from the section, namely development region, that supplies the toners in the respective colors stored in the development units 31Y, 31M, 31C and 31Bk. Herein, leaking of toner from a section other than the development section, without through the development rollers 32Y, 32M, 32C and 32Bk, must be prevented, because toner having leaked spatters to affect the exposure optical path and causes contamination of the inside of the image forming apparatus. Each of development units 31Y, 31M, 31C and 31Bk is formed in a combination of plural hard members, and the jointing section of the plural hard members is subjected to sealing, provided with soft members, so as to prevent leakage of toner.

Figure 2:
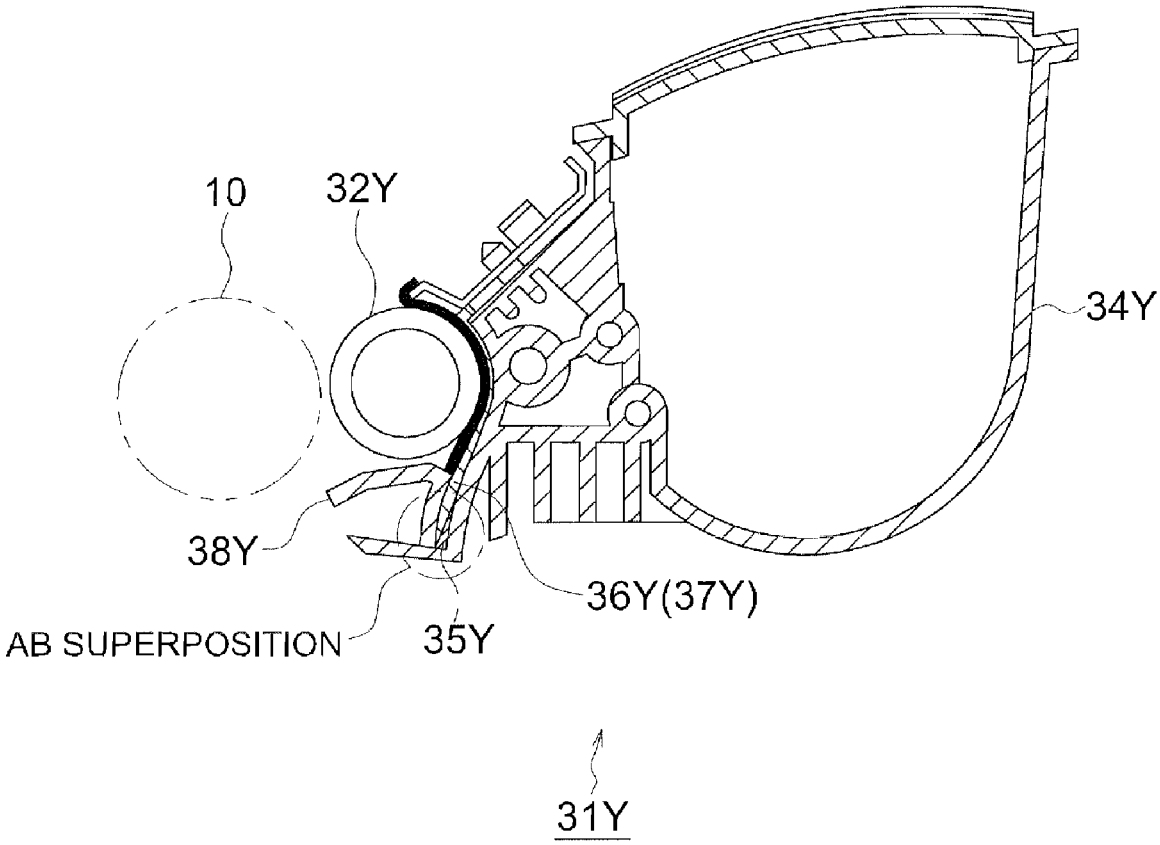
FIG. 2 is a cross-sectional view showing the schematic structure of a development device as an example in the present embodiment of the invention.

FIG. 2 is a schematic diagram showing the cross-section of the development unit 31Y as a usable example of the four development units 31Y, 31M. 31C and 31Bk of the full-color development device 30. FIG. 2 shows the state where the full-color development device 30 has rotated, and the development unit 31Y is guided to the position facing the photoreceptor drum 10. The structure of the development units will be described below, taking an example of the development unit 31Y. However, as described above, since the development units 31Y, 31M, 31C and 31Bk have the same structure, description of the other development units 31M, 31C and 31Bk will be omitted. In the following description, members and structures common to the development units 31Y, 31M, 31C and 31Bk will be represented by numeric symbols, wherein in order to represent members and structures of the development units 31Y, 31M, 31C and 31Bk, characters Y, M, C and Bk will be added following the numeric symbols representing the common members and structures.

In FIG. 2, the development roller 32Y is located at the position facing the photoreceptor drum 10. The container 34Y of the development unit 31Y is constructed with plural hard members. Yellow toner is stored in the container 34Y, and supplied from an opening of the container 34Y in the development region through the development roller 32Y to the photoreceptor drum 10. The sealing member A, represented by 35Y, corresponds to a soft member referred to in the present invention, and prevents leakage of toner from the lower part, in the figure, of the development unit 31Y. Further, the sealing member B, represented by 36Y, corresponds to a soft member referred to in the present invention, and prevents leakage of toner from an end portion of the development roller 32Y of the development unit 31Y. Further, a sealing member C (37Y), is arranged at the other end portion of the development roller 32Y. Accordingly, the sealing member B (36Y) and sealing member C (37Y) prevent toner leakage from the vicinity of the development region of the development roller 32Y.

The sealing members A, B and C will be described later in more details.

A lower part press member 38Y formed of a hard material is a press member to fix the sealing members A, B and C to the development unit container 34Y. The lower part press member 38Y is screw fixed at a predetermined position of the development unit container 34Y with plural screws, not shown, and sandwiches the sealing members A, B and C with the development unit container 34Y to fix them. The AB superposition, shown in FIG. 2, is a section where the sealing members A and B are superimposedly sandwiched by the lower part press member 38Y and the development unit container 34Y. Likewise, on the front side in the perpendicular direction with respect to the page of FIG. 2, located is AC superposition, not shown in FIG. 2, where the sealing members A and C are superimposedly sandwiched by the lower part press member 38Y and the development unit container 34Y.

Figure 3:
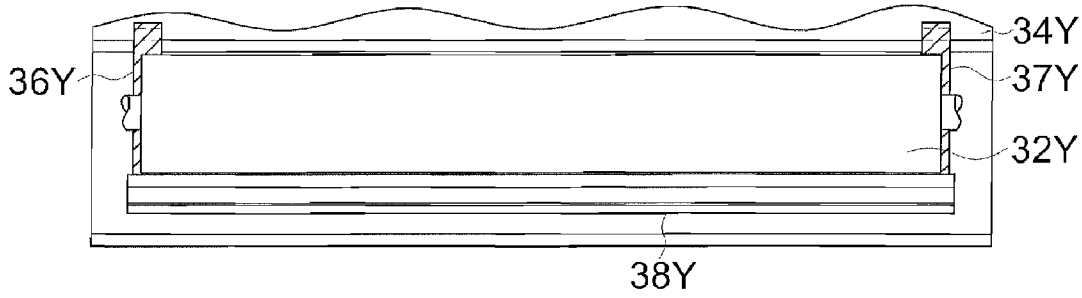
FIG. 3 is a conceptual view of the development position of the development device in accordance with the present embodiment of the invention, viewed from the photoreceptor drum side.
Figure 3:
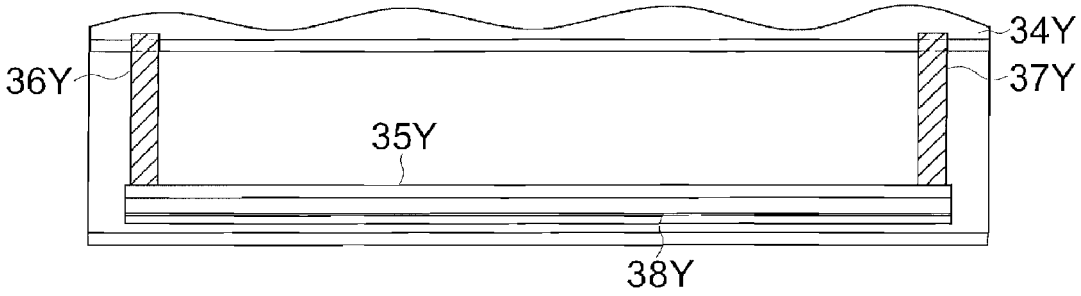
Figure 3:
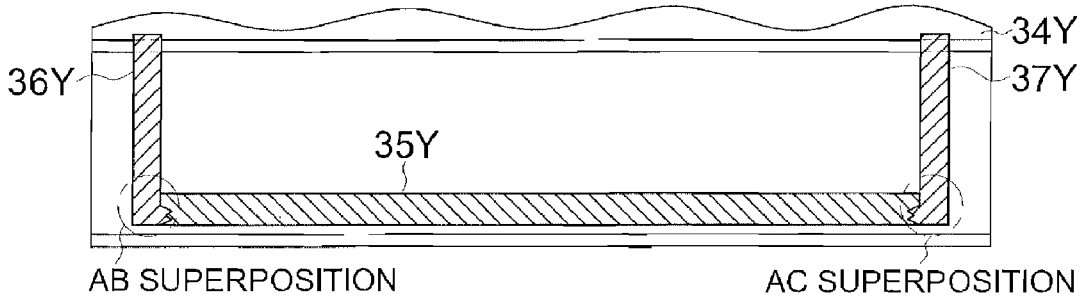
Figure 3:
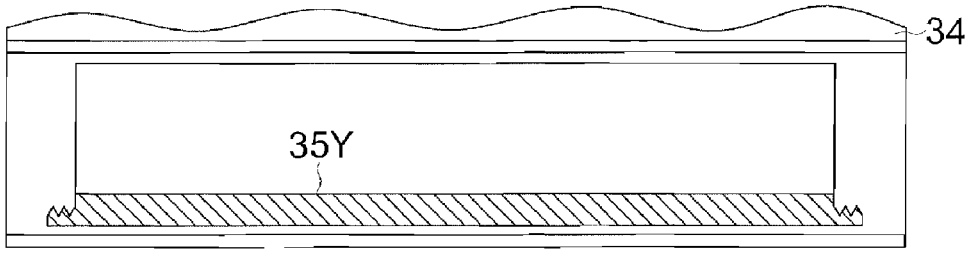

Herein, the sealing members A, B and C, corresponding to soft members referred to in the present invention, will be described further in details, referring to FIGS. 3*a* to 3*d*. FIG. 3*a* is a fragmental conceptual view of the development unit 31Y in the present embodiment, viewed from the side of the photoreceptor drum 10. The development unit 31Y in the present embodiment is provided with the sealing member A (35Y), the sealing member B (36Y), and the sealing member C (37Y). The sealing member A (35Y) prevents leakage of toner from the lower position, in the figure, of the development roller 32Y. The sealing members B (36Y) and C (37Y) prevent leakage of toner from the left and right end portions, in the figure, of the development roller 32Y. The back side, in the perpendicular direction with respect to the page sheet, of the sealing members B (36Y) and C (37Y) are respectively fixed to the development unit container 34Y. The sealing member B (36Y) and sealing member C (37Y) are not fixed to the development unit container 34Y at the AB superposition and the AC superposition. At the AB superposition and AC superposition, the end portions of the sealing member A (35Y) are respectively inserted between the sealing member B (36Y) and the development unit container 34Y and between the sealing member C (37Y) and the development unit container 34Y to be superposed. The sealing member A (35Y) is fitted to the development unit container 34Y in a state where the left and right end portions of the sealing member A (35Y) are respectively superposed with the sealing member B (36Y) and the sealing member C (37Y) and sandwiched by the lower part press member 38Y and the development unit container 34Y. Herein, the lower part press member 38Y and the development unit container 34Y hold the sealing members A, B and C being soft members, and are hard members referred to in the present invention.

In FIG. 3*b*, the development roller 32Y is removed from FIG. 3*a*. Further, in FIG. 3*c*, the lower part press member 38Y is removed from FIG. 3*b*. Still further, in FIG. 3*d*, the sealing members B (36Y) and C (37Y) are removed from FIG. 3*c*. As shown in FIGS. 3*b*, 3*c*, and 3*d*, the sealing members B (36Y) and C (37Y) are fitted, with the respective end portions superposed with the sealing member A (35Y). The AB superposition, shown in FIG. 3*c*, is the position where the sealing member A (35Y) and sealing member B (36Y) superpose with each other, and the AC superposition, shown in FIG. 3*c*, is the position where the sealing member A (35Y) and sealing member C (37Y) superpose with each other. The both end portions of the sealing member A (35Y) are superposed respectively with the sealing member B (36Y) at the AB superposition and with the sealing member C (37Y) at the AC superposition, and thus incorporated to a predetermined position and fixed by the lower part press member 38Y. Thus, the sealing members A (35Y), B (36Y), and C (37Y) are sandwiched by the lower par press member 38Y and the development unit container 34*y* at the AB superposition and AC superposition in a pressed state.

Now, the respective sealing members and the shapes of the respective sealing members at the superpositions will be described in details.

Figure 4:
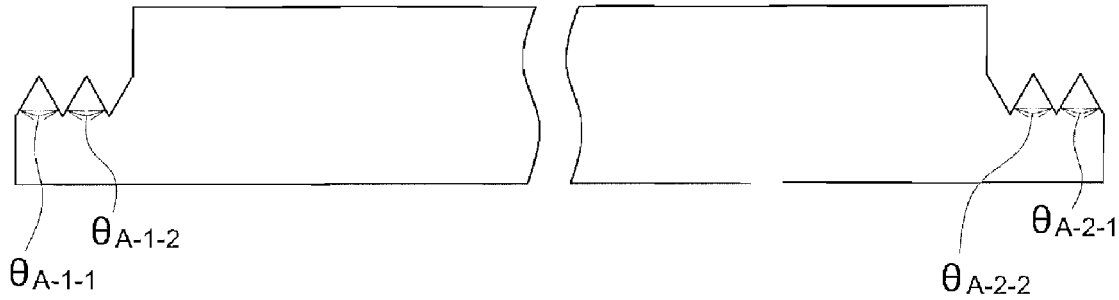
FIGS. 4*a* and 4*b* are diagrams showing the details of a sealing member A.
Figure 4:
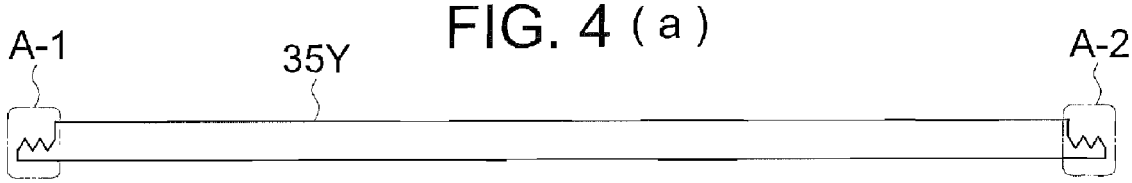

FIGS. 4*a* and 4*b* are diagrams showing the details of the sealing member 35Y. The sealing member A (35Y) is formed of a soft polyurethane foam of which hardness is 100 N by D method of JIS K 6400. As shown in FIG. 4*a*, the sealing member A (35Y) is provided with A-1 section and A-2 section respectively at the left and right ends as end portions, shown in the figure, wherein the A-1 and A-2 sections have shape sections that the widths of the shape sections become smaller toward the tip end with a plurality of tapered segments. The A-1 and A2 sections have two shape sections, which are later called triangle shaped sections, with plural tapered segments. Herein, the number of the triangle shaped sections is not limited to two, and is preferably greater than one, namely, plural. Further, the angles of the vertexes of the plural triangle shapes at the end portions of the soft member are preferably in a range from 25 to 150 degrees. As shown in FIG. 4*b*, it is assumed that the angles of the vertexes of the plural triangle shapes that form plural tapered segments at the A-1 section of the sealing member A (35Y) are respectively $\theta_{A\text{-}1\text{-}1}$ and $\theta_{A\text{-}1\text{-}2}$, and the angles of the vertexes of the plural triangle shapes that form plural tapered segments at the A-2 section of the sealing member A (35Y) are respectively $\theta_{A\text{-}2\text{-}1}$ and $\theta_{A\text{-}2\text{-}2}$. With regard to the sealing member A (35Y) in the present embodiment of the invention, the angles $\theta_{A\text{-}1\text{-}1}$ and $\theta_{A\text{-}1\text{-}2}$ of the vertexes of the triangle shapes of the A-1 section are both 27 degrees, and the angles $\theta_{A\text{-}2\text{-}1}$ and $\theta_{A\text{-}2\text{-}2}$ of the vertexes of the triangle shapes of the A-2 section are both 27 degrees. This structure corresponds to Inventive Example 1 in a confirmation test described later.

Figure 5:
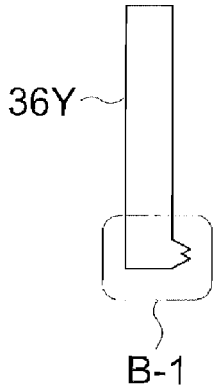
FIGS. 5*a* and 5*b* are diagrams showing the details of a sealing member B.
Figure 5:
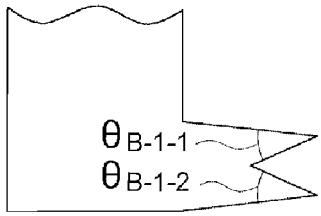

FIGS. 5*a* and 5*b* are diagrams showing the details of the sealing member B (36Y). The sealing member B (36Y) is formed of a soft polyurethane foam with a hardness of 100 N in accordance with D method of JIS K 6400. FIG. 5*a* is an entire view of the sealing member B (36Y), and FIG. 5*b* is a fragmental enlarged view of it. As shown in FIG. 5*a*, the sealing member B (36Y) has an end portion, namely B-1 section, having shape sections, on the lower side in the figure, that form plural tapered segments and becoming thinner toward the tip end. The B-1 section is provided with two triangle shaped sections that form plural tapered segments. Herein, the number of the triangle shaped sections at an end of the soft member is not limited to two, and is preferably greater than one, namely plural. Further, the angles of the vertexes of the plural triangle shapes at the end portion of the soft member are preferably in a range from 25 to 150 degrees. As shown in FIG. 5*b*, it is assumed that the angles of the vertexes of the plural triangle shapes that form plural tapered segments at the B-1 section of the sealing member B (36Y) are respectively $\theta_{B\text{-}1\text{-}1}$ and $\theta_{B\text{-}1\text{-}2}$. With regard to the sealing member B (36Y) in the present embodiment of the invention, the angles $\theta_{B\text{-}1\text{-}1}$ and $\theta_{B\text{-}1\text{-}2}$ of the vertexes of the triangle shapes of the B-1 section are both 30 degrees. Herein, this structure corresponds to Inventive Example 1 in the later described confirmation test.

Figure 6:
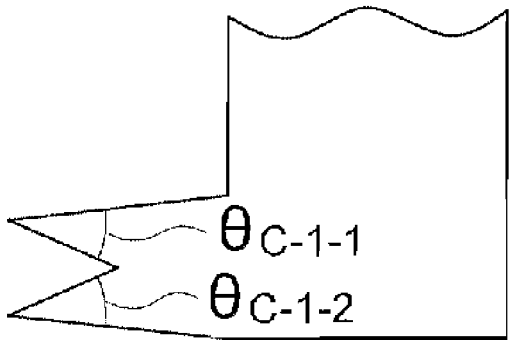
FIGS. 6*a* and 6*b* are diagrams showing the details of a sealing member C.
Figure 6:
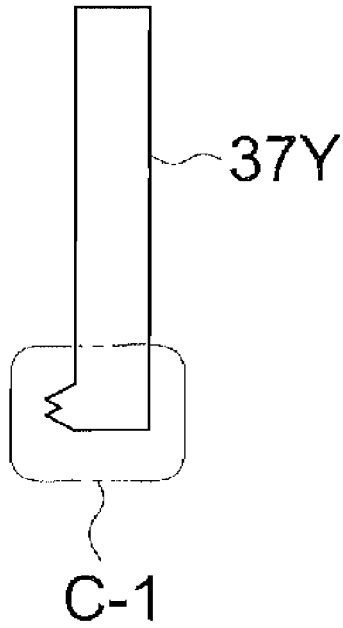

FIGS. 6*a* and 6*b* are diagrams showing the details of the sealing member C (37Y). The sealing member C (37Y) is formed of a soft polyurethane foam with a hardness of 100 N in accordance with D method of JIS K 6400. FIG. 6*a* is an entire view of the sealing member C (37Y), and FIG. 6*b* is a fragmental enlarged view of it. As shown in FIG. 6*a*, the sealing member C (37Y) has an end portion, namely C-1 section, having shape sections, on the lower side in the figure, that form plural tapered segments and becoming thinner toward the tip end. The C-1 section is provided with two triangle shaped sections that form plural tapered segments. Herein, the number of the triangle shaped sections at an end of the soft member is not limited to two, and is preferably greater than one, namely plural. Further, the angles of the vertexes of the plural triangle shapes at the end portion of the soft member are preferably in a range from 25 to 150 degrees. As shown in FIG. 6*b*, it is assumed that the angles of the vertexes of the plural triangle shapes that form plural tapered segments at the C-1 section of the sealing member C (37Y) are respectively $\theta_{C\text{-}1\text{-}1}$ and $\theta_{C\text{-}1\text{-}2}$. With regard to the sealing member C (37Y) in the present embodiment of the invention, the angles $\theta_{C\text{-}1\text{-}1}$ and $\theta_{C\text{-}1\text{-}2}$ of the vertexes of the triangle shapes of the C-1 section are both 30 degrees. Herein, this structure corresponds to Inventive Example 1 in the later described confirmation test.

Figure 7:
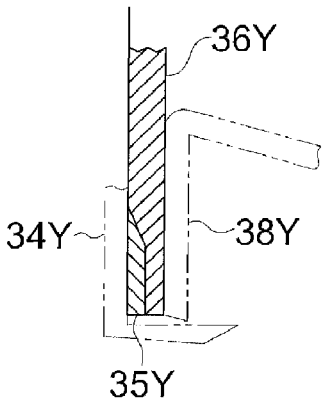
FIGS. 7*a* to 7*c* are diagrams illustrating the shapes of the sealing members A and B at the A-B superposing section.
Figure 7:
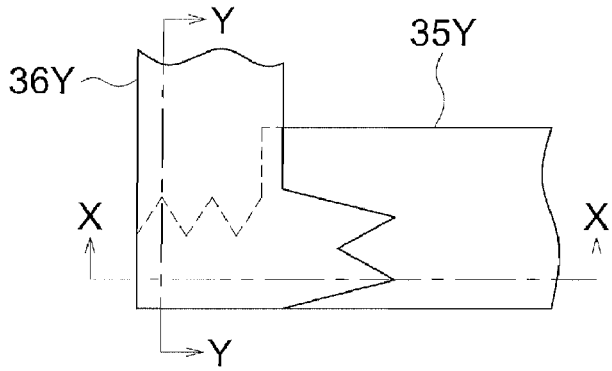
Figure 7:
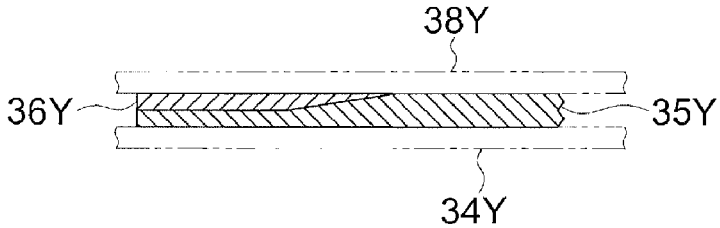

FIGS. 7*a* to 7*c* are diagrams showing shapes of the sealing member A (35Y) and sealing member B (36Y) at the AB superposition, which is one of the superpositions. FIG. 7*a* is a top view of showing a state where the sealing member A (35Y) and sealing member B (36Y) are superposed with each other. As shown in FIG. 7*a*, the end portion A-1 of the sealing member A (35Y) and the end portion B-1 of the sealing member B (36Y) are superposed with each other at the AB superposition. FIG. 7*b* is a cross-sectional view of the sealing member B (36Y) with respect to a cross-section X-X passing through the vertex of one of the triangles at the tip end of the end portion B-1. As shown in FIG. 7*b*, the sealing member A (35Y) and sealing member B (36Y) are pressed at the AB superposition by the lower part press member 38Y to be compressed such that the vertexes of the triangles at the end portion B-1 of the sealing member B (36Y) is at substantially the same height as the surface of the sealing member A (35Y), causing no step at the superposition. FIG. 7*c* is a cross-sectional view of the sealing member A (35Y) with respect to a cross-section Y-Y passing through the vertex of one of the triangles at the tip end of the end portion A-1. As shown in FIG. 7*c*, the sealing member A (35Y) and sealing member B (36Y) are pressed at the AB superposition by the lower part press member 38Y to be compressed such that the vertexes of the triangles at the end portion A-1 of the sealing member A (35Y) are at substantially the same height as the surface of the sealing member B (36Y), causing no step at the superposition.

Figure 8:
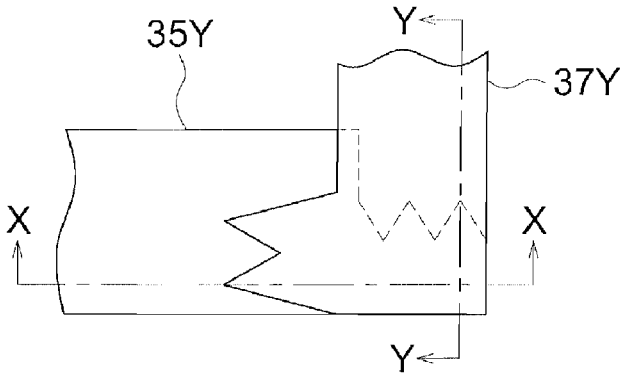
FIGS. 8*a* to 8*c* are diagrams illustrating the shapes of the sealing members A and C at the A-C superposing section.
Figure 8:
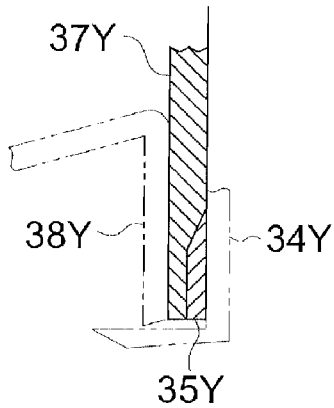
Figure 8:
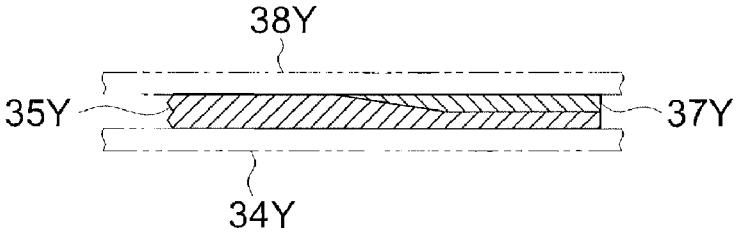

FIGS. 8*a* to 8*c* are diagrams showing shapes of the sealing member A (35Y) and sealing member C (37Y) at the AC superposition, which is one of the superpositions. FIG. 8*a* is a top view of showing a state where the sealing member A (35Y) and sealing member C (37Y) are superposed with each other. As shown in FIG. 8*a*, the end portion A-1 of the sealing member A (35Y) and the end portion C-1 of the sealing member C (37Y) are superposed with each other at the AC superposition. FIG. 8*b* is a cross-sectional view of the sealing member C (37Y) with respect to a cross-section X-X passing through the vertex of one of the triangles at the tip end of the end portion C-1. As shown in FIG. 8*b*, the sealing member A (35Y) and sealing member C (37Y) are pressed at the AC superposition by the lower part press member 38Y to be compressed such that the vertexes of the triangles at the end portion C-1 of the sealing member C (37Y) is at substantially the same height as the surface of the sealing member A (35Y), causing no step at the superposition. FIG. 8*c* is a cross-sectional view of the sealing member A (35Y) with respect to a cross-section Y-Y passing through the vertex of one of the triangles at the tip end of the end portion A-2. As shown in FIG. 8*c*, the sealing member A (35Y) and sealing member C (37Y) are pressed at the AC superposition by the lower part press member 38Y to be compressed such that the vertexes of the triangles at the end portion A-2 of the sealing member A (35Y) is at substantially the same height as the surface of the sealing member C (37Y), causing no step at the superposition.

As described above, in order to seal a development unit constructing the development device in accordance with the present embodiment, a combination of several sealing members formed of a soft urethane foam is incorporated at a desired section of the development unit in such a manner that the widths of the shapes of the sealing members in a region of superposition with each other are smaller toward the respective tip ends, thereby making the contact areas between each other small. Thus, when the sealing members are pressed by a press member at the superpositions, the compression amounts of the sealing members, at positions where the areas of the sealing members are small, become large, causing no step at the superpositions. Accordingly, generation of steps at the superpositions, which could cause leakage of toner, is prevented.

INVENTIVE EXAMPLES

The present embodiment of the invention will be described in details below specifically with examples, however, the invention is not limited thereto.

1. Content of Experiment

Development units incorporated with various sealing members, described later in the description of Test 1 and Test 2, were produced, and the produced development units were mounted for evaluation on a color laser printer (Magicolor 2300DL produced by Konica Minolta Business Technologies Inc.), which is in the market. The evaluation was made on continuous printing of 3000 sheets for each development unit under environment of ordinary temperature and humidity (20° C. and 10% RH).

Printing was performed, using only toner in block color and an image with a picture element rate of 10% (an original image with equal quarters of a character image with a picture element rate of 7% (characters of 4, 6, and 8 points), a photograph of a person's profile, a solid white image, and a solid black image), and a monochrome image was formed on bond paper sheets in A4 size (CF paper produced by Konica Minolta Business Technologies Inc.).

2. Evaluation Items (Contamination in Apparatus)

The state of scattering of toner from the development units after continuous printing of 3000 sheets by the respective development units was visually evaluated, and further staining of hands was evaluated when the task of removing the development units was carried out.

A: Contamination in the apparatus was not observed, and the hands were not stained at all by removing the development units.

B: Adherence of toner to the upper lids adjacent to the development rollers was observed. However, the hands were not stained by removing the development units.

C: Adherence of toner to certain parts of the upper lids of the development units in the apparatus was observed. However, scattering of toner in the apparatus was not observed. Further, the hands were not stained by removing the development units.

D: Scattering of toner in the apparatus was recognized. Further, the hands were stained by removing the development units, to an extent that requires washing of the hands.

(Image Contamination)

Upon performing continuous printing of 3000 sheets by the respective development units, respective three continuous printed sheets centering on the 500$^{th}$, 1000$^{th}$, 2000$^{th}$, and 3000th were observed by a loupe with a scale and visually, and presence or non-presence of a black spot caused by dropping of toner from the development units was evaluated.

A: Generation of a black spot was not recognized on three prints.

B: A black spot was recognized on one of three prints. However, the black spot was smaller than 0.4 mm, and it was concluded that there is no problem with the image.

C: A black spot was recognized on plural printed sheets. However, the black holes were smaller than 0.4 mm, and it was concluded that there is no problem with the image.

D: A black spot not smaller than 0.4 mm was recognized on plural printed sheets.

3. Test 1

Development units incorporated with sealing members formed with the following angles of the respective vertexes of the above described triangle shapes were used for Inventive examples 1 to 3 and Comparative Examples 1 and 2. Herein, a soft polyurethane foam with a hardness of 100 N in accordance with D method of JIS K 6400-2 was employed for the respective sealing members.

Inventive Example 1 sealing member A $\theta_{A\text{-}1\text{-}1}$, $\theta_{A\text{-}1\text{-}2}$, $\theta_{A\text{-}2\text{-}1}$, and $\theta_{A\text{-}2\text{-}2}$=27°
sealing member B $\theta_{B\text{-}1\text{-}1}$ and $\theta_{B\text{-}1\text{-}2}$=30°
sealing member C $\theta_{C\text{-}1\text{-}1}$ and $\theta_{C\text{-}1\text{-}2}$=30°

Inventive Example 2 sealing member A $\theta_{A\text{-}1\text{-}1}$, $\theta_{A\text{-}1\text{-}2}$, $\theta_{A\text{-}2\text{-}1}$, and $\theta_{A\text{-}2\text{-}2}$=25°
sealing member B $\theta_{B\text{-}1\text{-}1}$ and $\theta_{B\text{-}1\text{-}2}$=25°
sealing member C $\theta_{C\text{-}1\text{-}1}$ and $\theta_{C\text{-}1\text{-}2}$=25°

Inventive Example 3 sealing member A $\theta_{A\text{-}1\text{-}1}$, $\theta_{A\text{-}1\text{-}2}$, $\theta_{A\text{-}2\text{-}1}$, and $\theta_{A\text{-}2\text{-}2}$=150°
sealing member B $\theta_{B\text{-}1\text{-}1}$ and $\theta_{B\text{-}1\text{-}2}$=150°
sealing member C $\theta_{C\text{-}1\text{-}1}$ and $\theta_{C\text{-}1\text{-}2}$=150°

Comparative Example 1 sealing member A $\theta_{A\text{-}1\text{-}1}$, $\theta_{A\text{-}1\text{-}2}$, $\theta_{A\text{-}2\text{-}1}$, and $\theta_{A\text{-}2\text{-}2}$=180° (no bend)
sealing member B $\theta_{B\text{-}1\text{-}1}$ and $\theta_{B\text{-}1\text{-}2}$=180° (no bend)
sealing member C $\theta_{C\text{-}1\text{-}1}$ and $\theta_{C\text{-}1\text{-}2}$=180° (no bend)

Occurrence/No Occurrence determination result of toner leakage in Inventive Examples 1 to 3 and Comparative Example 1 are shown in Table 1.

TABLE 1

| | Seal member A Angle of vertex (°) | | | | | Seal member B Angle of vertex (°) | | | Seal member C Angle of vertex (°) | | | Toner Leakage Determination Image Contamination (Number of Continuous prints) | | | | |
|---|---|---|---|---|---|---|---|---|---|---|---|---|---|---|---|---|
| | $\theta_{A\text{-}1\text{-}1}$ | $\theta_{A\text{-}1\text{-}2}$ | $\theta_{A\text{-}2\text{-}1}$ | $\theta_{A\text{-}2\text{-}2}$ | *1 | $\theta_{B\text{-}1\text{-}1}$ | $\theta_{B\text{-}1\text{-}2}$ | *1 | $\theta_{C\text{-}1\text{-}1}$ | $\theta_{C\text{-}1\text{-}2}$ | *1 | 500 | 1000 | 2000 | 3000 | *2 |
| Inv. 1 | 27 | 27 | 27 | 27 | 100 | 30 | 30 | 100 | 30 | 30 | 100 | A | A | A | A | A |
| Inv. 2 | 25 | 25 | 25 | 25 | | 25 | 25 | | 25 | 25 | | A | A | A | A | A |
| Inv. 3 | 150 | 150 | 150 | 150 | | 150 | 150 | | 150 | 150 | | A | A | B | B | B |
| Com. 1 | 180** | 180** | 180** | 180** | | 180** | 180** | | 180** | 180** | | C | D | D | D | D |

Inv.: Inventive Example,
Comp.: Comparative Example
*1: Hardness (N),
**(No bend)
*2: Contamination in Apparatus As shown in Table 1, in Inventive Examples 1 to 3 in accordance with the invention, occurrence of image contamination nor contamination in the apparatus was not observed, and it was confirmed that the present invention is effective. On the other hand, in Comparative Example 1, image contamination occurred at the time of printing 1000th sheet, and contamination in the apparatus was also recognized.

4. Test 2

Same as the sealing members used in Inventive Example 1, the vortex angles of triangle shapes of seal embers were set to 27° for a sealing member A and 30° for sealing members B and C. Development units were prepared, using the sealing members with the following values of hardness of the seals measured by JIS K 6400 D Method (for Inventive Examples 1, and 4 to 8).

Inventive Example 1: 100 N
Inventive Example 4: 10 N
Inventive Example 5: 50 N
Inventive Example 6: 200 N
Inventive Example 7: 400 N
Inventive Example 8: 460 N Sealing members of hard rubber (material: neoplane, JIS-A hardness 90) were used fore Comparative Example 2. Evaluation results of Inventive Examples 1, and 4 to 8, and Comparative Example 2 are shown in Table 2.

TABLE 2

| | Seal member A Angle of vertex (°) | | | | | Seal member B Angle of vertex (°) | | | Seal member C Angle of vertex (°) | | | Toner Leakage Determination Image Contamination (Number of Continuous prints) | | | | |
|---|---|---|---|---|---|---|---|---|---|---|---|---|---|---|---|---|
| | $\theta_{A\text{-}1\text{-}1}$ | $\theta_{A\text{-}1\text{-}2}$ | $\theta_{A\text{-}2\text{-}1}$ | $\theta_{A\text{-}2\text{-}2}$ | *1 | $\theta_{B\text{-}1\text{-}1}$ | $\theta_{B\text{-}1\text{-}2}$ | *1 | $\theta_{C\text{-}1\text{-}1}$ | $\theta_{C\text{-}1\text{-}2}$ | *1 | 500 | 1000 | 2000 | 3000 | *2 |
| Inv. 1 | 27 | 27 | 27 | 27 | 100 | 30 | 30 | 100 | 30 | 30 | 100 | A | A | A | A | A |
| Inv. 4 | | | | | 10 | | | 10 | | | 10 | A | B | B | C | C |
| Inv. 5 | | | | | 50 | | | 50 | | | 50 | A | B | B | B | B |
| Inv. 6 | | | | | 200 | | | 200 | | | 200 | A | A | A | A | A |
| Inv. 7 | | | | | 400 | | | 400 | | | 400 | A | A | B | B | B |
| Inv. 8 | | | | | 460 | | | 460 | | | 460 | B | C | C | C | C |
| Comp. 2 | | | | | — | | | — | | | — | C | D | D | D | D |

Inv. Inventive Example,
Comp. Comparative Example
*1: Hardness (N),
*2: Contamination in Apparatus In Inventive Examples 1, and 4 to 8 in accordance with the invention, occurrence of image contamination nor contamination in the apparatus was not observed, and it was confirmed that the present invention is effective. On the other hand, in Comparative Example 2, image contamination occurred at the time of printing 1000 sheets, and contamination in the apparatus was also recognized.

As has been mentioned above in accordance with the invention, there is provided a development device sealed with a structure incorporated with a combination of several divided sealing members being soft members at a desired section, constructed with hard members, of the development unit, wherein the widths of the shape sections of the sealing members being soft members are thinner toward the respective tip ends, and the sealing members are disposed such that an end portion of one sealing member is superposed with another sealing member, thus making it possible to prevent leakage of toner from the jointing sections of the sealing members.

What is claimed is:

1. A development device, comprising:

a plurality of soft members, wherein at least one of the plurality of soft members has an end portion having a shape section having a width smaller toward a tip end of the end portion;

and wherein the tip end of the end portion having a width smaller towards the tip end entirely overlaps another one of the soft members.

2. The development device of claim 1, wherein the shape section of the end portion has a plurality of tapered segments.

3. The development device of claim 2, wherein the plurality of the tapered segments each have a vertex at the tip end of the end portion.

4. The development device of claim 3, wherein an angle of the vertex is in a range from 25° to 150°.

5. The development device of claim 3, wherein the end portion is provided with a plurality of shape sections each of which has a tapered segment and each of which has a vertex at the tip end of the end portion.

6. The development device of claim 4, wherein the end portion is provided with a plurality of shape sections each of which has a tapered segment and each of which has a vertex at the tip end of the end portion.

7. The development device of claim 1, wherein the end portion on the side where the width of the shape section is smaller toward the tip end thereof is placed on the other soft member.

8. The development device of claim 2, wherein the end portion on the side where the width of the shape section is smaller toward the tip end thereof is placed on the other soft member.

9. The development device of claim 3, wherein the end portion on the side where the width of the shape section is smaller toward the tip end thereof is placed on the other soft member.

10. The development device of claim 4, wherein the end portion on the side where the width of the shape section is smaller toward the tip end thereof is placed on the other soft member.

11. The development device of claim 5, wherein the end portion on the side where the width of the shape section is smaller toward the tip end thereof is placed on the other soft member.

12. The development device of claim 6, wherein the end portion on the side where the width of the shape section is smaller toward the tip end thereof is placed on the other soft member.

13. The development device of claim 6, wherein the plurality of soft members are sealing members.

14. The development device of claim 1, wherein a force in a range from 10 N to 400 N is required to press the soft members from an original thickness to a thickness of 25% of the original thickness.

15. The development device of claim 1, wherein thicknesses of each soft member returns to a range of 40% to 100% of an original thickness, after a hardness of the soft member is measured by D method of JIS K6400.

16. The development device of claim 1, wherein the soft members are formed of polyurethane foam.

* * * * *